US009107528B2

(12) United States Patent
Zolotov

(10) Patent No.: US 9,107,528 B2
(45) Date of Patent: Aug. 18, 2015

(54) DECORATIVELY APPLIED ARTICLE

(71) Applicant: Igor A. Zolotov, Tula (RU)

(72) Inventor: Igor A. Zolotov, Tula (RU)

( * ) Notice: Subject to any disclaimer, the term of this patent is extended or adjusted under 35 U.S.C. 154(b) by 0 days.

(21) Appl. No.: 14/047,965

(22) Filed: Oct. 7, 2013

(65) Prior Publication Data

US 2014/0079893 A1 Mar. 20, 2014

(51) Int. Cl.

| | |
|---|---|
| ***A47G 33/08*** | (2006.01) |
| ***A63H 33/00*** | (2006.01) |
| *D21J 3/10* | (2006.01) |

(52) U.S. Cl.
CPC ..... *A47G 33/08* (2013.01); *A63H 33/001* (2013.01); *D21J 3/10* (2013.01)

(58) Field of Classification Search
CPC ..... A47G 33/08; D21J 3/10; D21J 7/00; D21J 5/00
USPC ..... 446/5; 428/7, 11
See application file for complete search history.

(56) References Cited

U.S. PATENT DOCUMENTS

| | | | | |
|---|---|---|---|---|
| 4,819,963 | A * | 4/1989 | Wolski | 281/15.1 |
| 7,243,482 | B2 * | 7/2007 | Bezar | 53/468 |
| 2004/0137170 | A1 * | 7/2004 | Yu | 428/11 |

OTHER PUBLICATIONS eHow, "How to Make Papier Mache Ladybug", 2008, p. 1-2. Accessed on Sep. 9, 2014 at http://web.archive.org/web/20080324043924/http://www.ehow.com/how_2155604_make-papier-mache-ladybug.html.*

* cited by examiner

*Primary Examiner* — Humera Sheikh
*Assistant Examiner* — Julia L Rummel
(74) *Attorney, Agent, or Firm* — Inventa Capital PLC

(57) ABSTRACT

An ornamental article representing at least one blank in the form of a hollow three-dimensional component made out of molded paper pulp, different in that the product includes an insert of the same shape as the inner surface of the blank.

2 Claims, 8 Drawing Sheets

DECORATIVELY APPLIED ARTICLE

RELATED APPLICATIONS

This application claims priority to Patent Cooperation Treaty Application number PCT/RU2012/000241, filed on Apr. 3, 2012, which claims priority to Russian patent application serial number RU2011113495 filed on Apr. 8, 2011, and incorporated herewith by reference in its entirety.

This invention relates to light industries, namely to the industrial manufacturing of, mainly, toys and objects used in games and entertainment from moulded paper pulp.

Moulded pulp has much potential as a material for manufacturing blanks for ornamental items in the form of hollow three-dimensional objects because of its ecological properties and its capacity for surface treatment of different kinds. Papier Mache is somewhat similar to moulded pulp.

There exists a method for manufacturing products from Papier Mache (Invention Certificate 46783, published on 30 Apr. 1936) that includes wrapping several layers water-soaked of paper around a rotating wooden mandrel, then applying 5 or 6 layers of paper covered in glue paste, then drying. When the paper has been thoroughly dry, the model is cut into two symmetrical halves, the wooden mandrel is removed and the cut surfaces are pasted with carpenter's glue. Then the cuts are spread with carpenter's glue, joined together, and a piece of paper is glued over the seam.

There exists a method for making the ornamental layer stronger, improving the quality of products, shortening the time required for their production, and it is more economical (RF Patent No. 2132781, published on 10 Jul. 1999). A natural glue is liberally applied up to strips of cardboard, soaking them. As a strip of cardboard is being wound around a mandrel, it is glued with a polyvinyl-acetate-based glue. Then the bobbin produced is tied up with a strap of elastic material. The product is then sanded and polished until it becomes perfectly smooth. The finished item is then varnished several times with plenty of varnish.

Another patent (RF No. 2127785, published on Mar. 20, 1999) aimed at making Papier Mache more water proof. Paper material is wound around a mandrel of the same shape as the finished product. Each layer is spread with glue, then the blank is dried. The dry blank is then cut into several parts, removed from the mondrel, the parts are assembled, and the surface subjected to finishing operations. Prior to drying, the blank is contructed in the direction along the axis of the mandrel. Drying is carried out at room temperature until moisture reaches 8-10%, then the blank is impregnated with a paraffin/vegetable oil mixture, then the dry blank is cut into several parts, corresponding to the size of the finished product.

A common feature of all these methods was a blank in the form of hollow three-dimensional components made of paper pulp, which required gluing along the joints.

The invention described in RF patent No. 2127785 is the closest to the present invention from the point of view of the range of its essential characteristics, closer than the useful model described in RF Patent 52771 (published on Apr. 27, 2006). The ornamental product described in former one [1] includes a shape-forming base 6, which can be made of timber, glass, gypsum, porcelain or Papier Mache. Band 7, made of synthetic textile material (polyester, polyamide or polyether) is attached to base 6, then a surface coating 1 is attached to the band by heat sealing. The base stays inside the product, the blank is not dismantled into separate hollow components. Consequently, there is no need for connecting two hollow components to obtain a finished product.

The drawback of this method is the fact that dimensions of spatially-rigid hollow objects produced by this method (in comparison with conventionally flat objects) lack stability. Because of this, the existing methods cannot be used in commercial manufacturing of uniform and, most important, interchangeable articles. This is the consequence of the varying moisture content in the blanks, even though they might have come from equipment of the same type. Varying moisture content is responsible for the considerable variation in sizes, so that it might become impossible to joint parts together.

The present invention aims at facilitating commercial production of ornamental objects from moulded paper pulp.

The technological result of this invention is uniformity of geometric dimensions and the improved structural rigidity of finished hollow products, which facilitates joining identical components (putting them together), in the process their commercial mass production and ensures that these components are interchangeable.

This task is carried out and the technological goal achieved as follows. An ornamental product, which includes at least one blank in the form of a hollow three-dimensional component made of moulded paper pulp, contains an insert of the same shape as the inner surface of the blank. The insert may carry an orifice, a notch for attaching a suspension or a counterweight. The three-dimensional components of the blank can be symmetrical or asymmetrical.

The invention is illustrated with the following diagrams:

Figure 1:
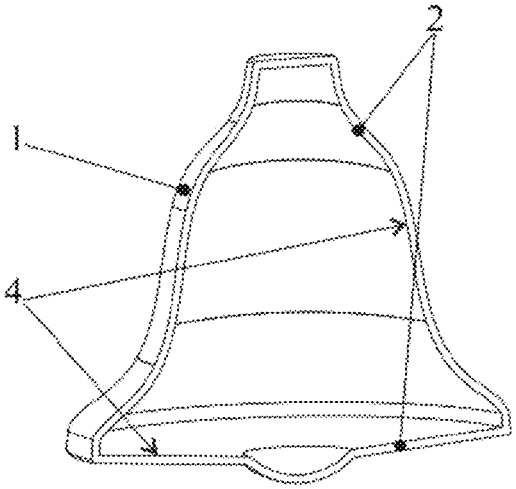
FIG. 1 shows a complete three-dimensional component of the ornamental product "the bell" ('the half-bell')
Figure 12:
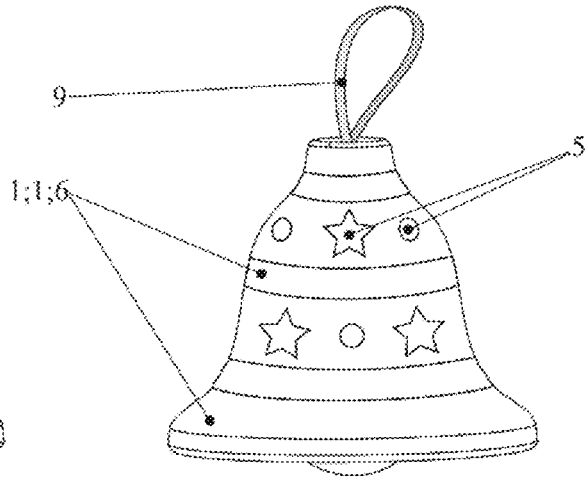
Figure 13:
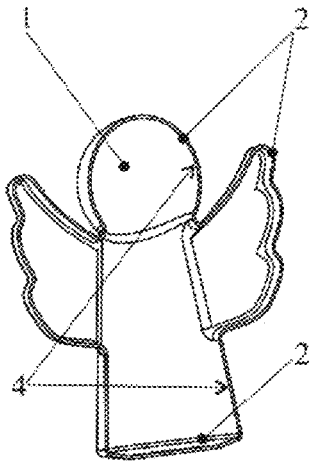
Figure 14:
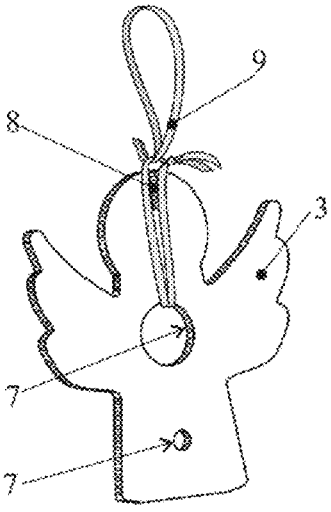
Figure 15:
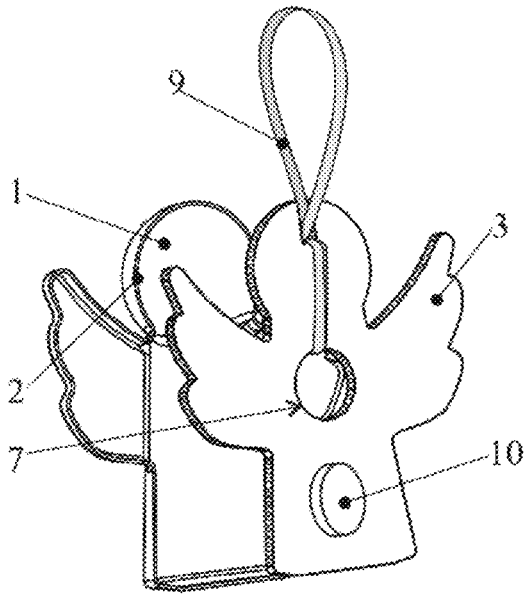
Figure 16:
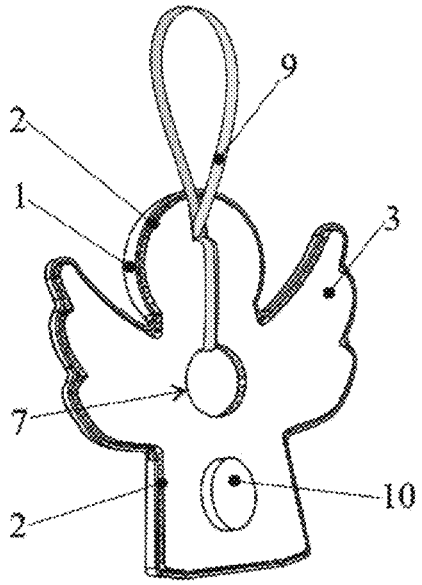
Figure 17:
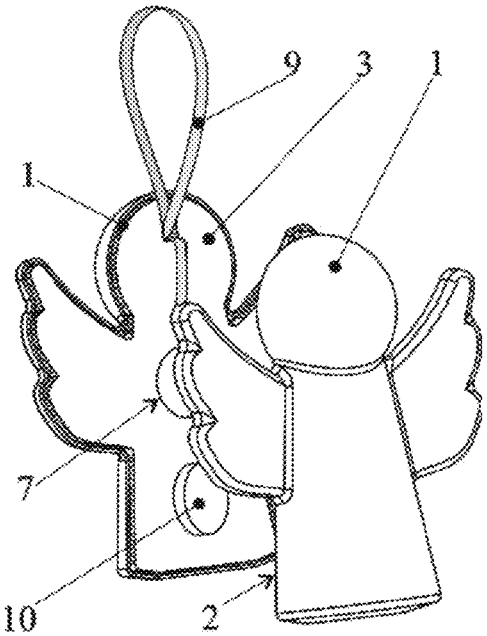
Figure 18:
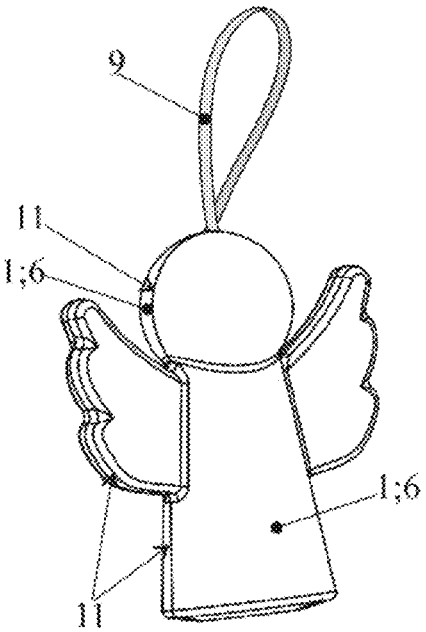
Figure 19:
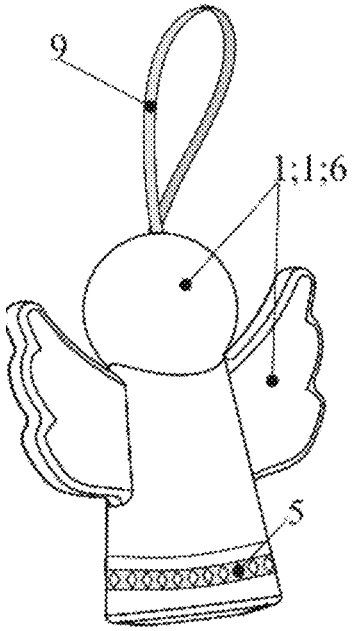
Figure 20:
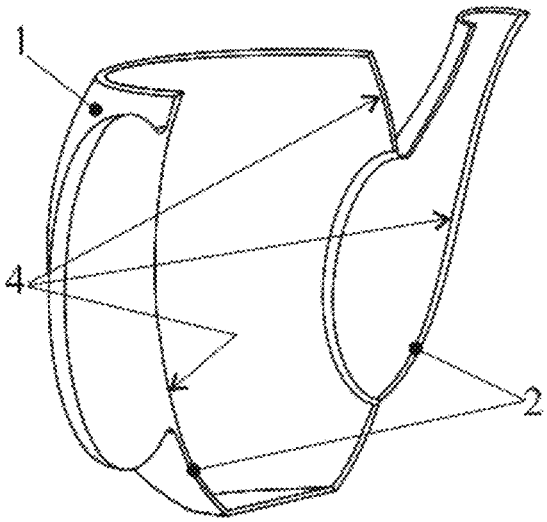
Figure 21:
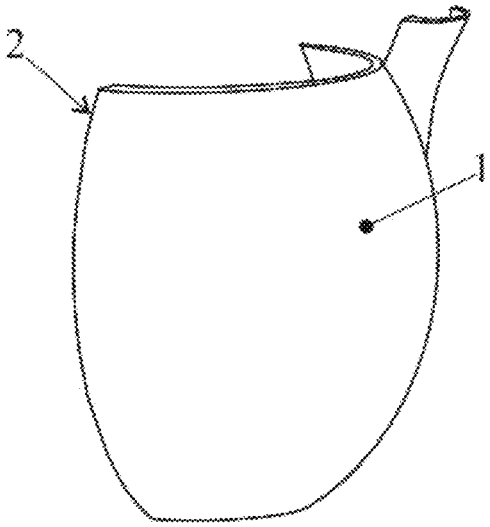
Figure 22:
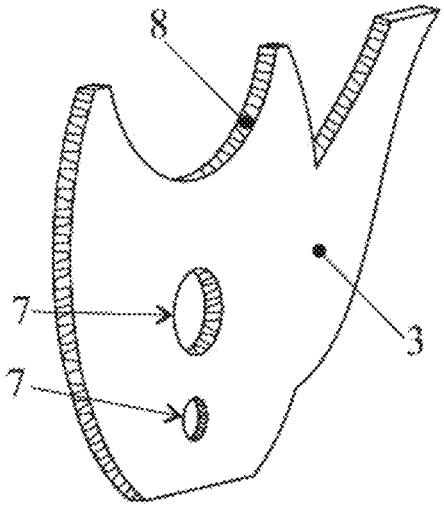
Figure 24:
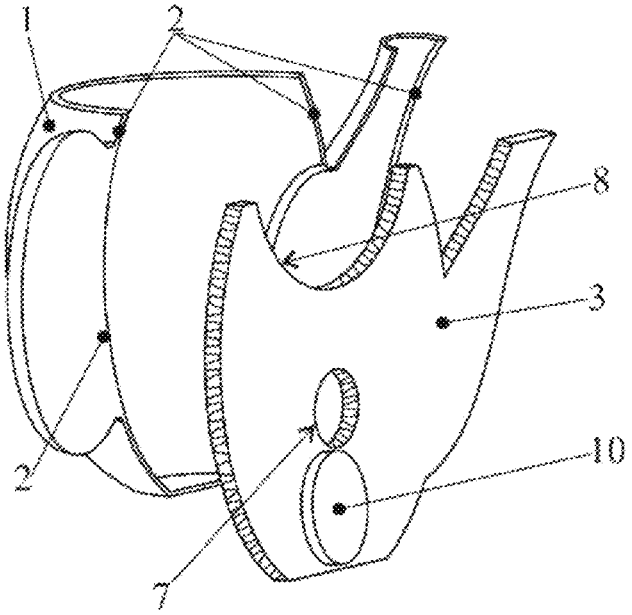
Figure 23:
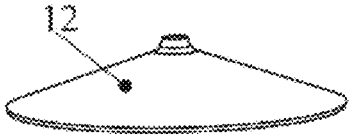
Figure 25:
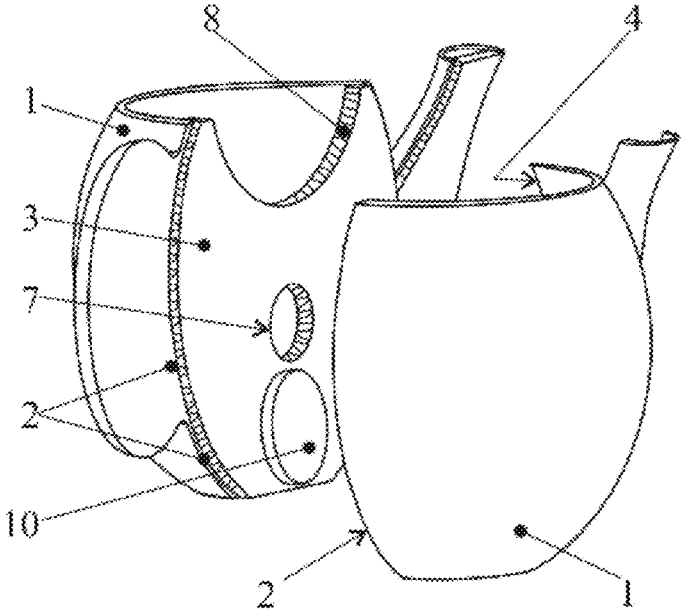
Figure 26:
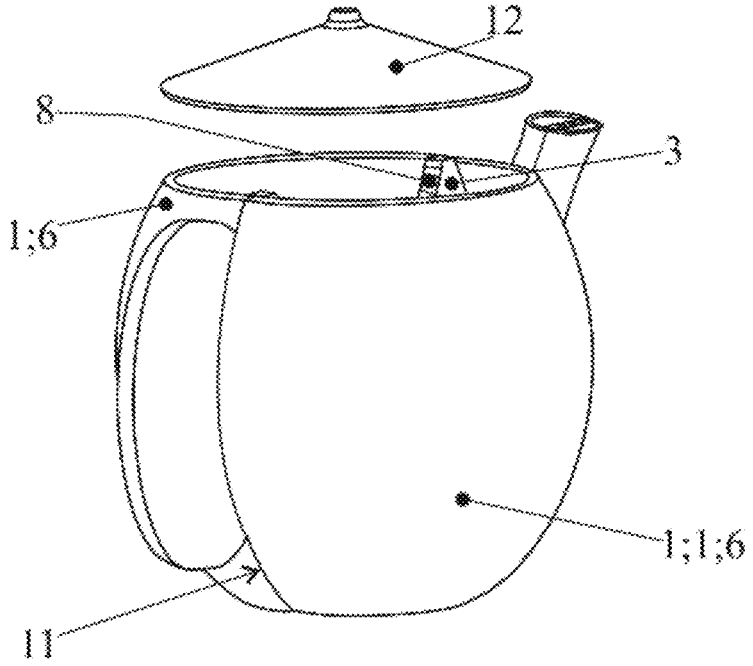
Figure 27:
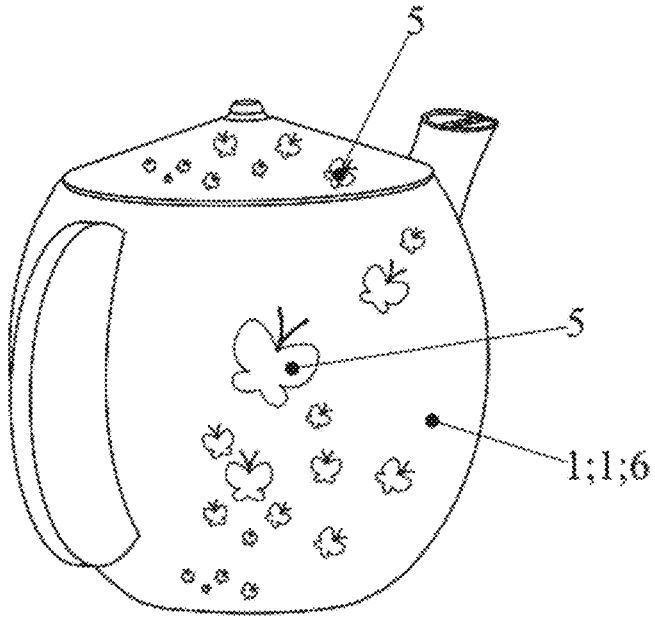

FIG. 12: a finished ornamental product "the Bell" with a suspension;

FIG. 13 shows the hollow three-dimensional component of the ornamental product "the angel";

FIG. 14 shows a flat calibrating insert of the hollow calibrating insert of the hollow three-dimensional component from FIG. 1 with a suspension and a hole for placing a counterweight into its bottom part;

FIG. 15 shows the preparation for assembly of the hollow three-dimensional component from FIG. 13 and the flat calibrating insert from FIG. 14 with a counterweight;

FIG. 16. shows the hollow three-dimensional component from FIG. 13 with the partly inserted flat calibrating insert from FIG. 14;

FIG. 17 shows preparation for assembly of the already assembled hollow three-dimensional component and a partly inserted flat calibrating insert (see FIG. 15) with the second hollow three-dimensional component from FIG. 13;

FIG. 18 shows the ornamental product "the angel" as a blank for painting and/or attaching images to its surface;

FIG. 19: the finished ornamental product "the angel" with a loop and counterweight;

FIG. 20: shows the first hollow three-dimensional component of the ornamental product "the teapot";

FIG. 21 shows the second hollow component of the ornamental object "teapot";

FIG. 22 shows the flat calibrating insert of the hollow three-dimensional components from FIGS. 20 and 21, with an additional hole for installation of a counterweight in its bottom part;

FIG. 23 shows the third separate hollow three-dimensional component of the ornamental object "teapot": the lid of the teapot;

FIG. 24 shows preparation for assembly of the hollow three-dimensional component from FIG. 20 with the flat calibrating insert from FIG. 22, with the counterweight in place;

FIG. 25 shows preparation for assembly of the a-priory assembled hollow three-dimensional component with the partly inserted flat calibrating insert from FIG. 24 with the second hollow three-dimensional component from FIG. 21;

FIG. 26 shows the ornamental product "teapot with a lid", ready to be painted an/or having images attached to its surface;

FIG. 27 shows the finished ornamental product "teapot with a lid" with a counterweight inside.

The ornamental article was manufactured from moulded paper pulp, a product of the processing of wastes, mainly secondary raw materials of paper production. It was manufactured in the form of a certain blank that included at least one hollow three-dimensional component 1 with cut edge 2, capable of being joined with the cut edge 2, which also is capable of being joined, producing permanent joint with a certain base surface (not shown in the diagrams) or with a corresponding cut edge 2' of the adjacent hollow three-dimensional component 1'. Calibrating piece 3 is placed inside hollow three-dimensional component 1. The insert is in contact with at least a part of inner surface 4 adjacent to the outline of the cut edge 2. The blank produced is then painted or has images 5 attached to its surface 6.

Figure 11:
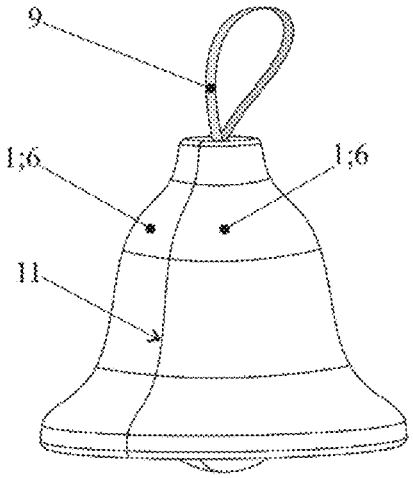
FIG. 11 shows the ornamental object "the Bell": a blank for painting and/or attaching images to its surface.

It is provided that calibrating piece 3 has at least one orifice 7 and one notch (nick) 8 where a suspension can be attached (a cord, a thread, a paper clip etc) 9 and/or counterweight 10 placed, or it can incorporate a magnet (not shown) or a piece of double-sided scotch (not shown). Calibrating piece 3 is capable of touch inner surface 4 of hollow three-dimensional component 1'. Joined hollow three-dimensional components 1 and 1' possess axial and/or flat symmetry, while their cut edges 2 and 2' either have match outline 4 (see FIGS. 11 and 18) or are asymmetrical, while their cut edges 2 and 2' match at least part of outline 4 (see FIG. 26). The assembly of hollow three-dimensional components 1 and 1' with each other and/or with the base surface and/or with flat calibrating insert 3 to form solid article is carried out with glue, forming seam 11.

Surface 6 of the blank can be subjected to an additional treatment: separate ornamental pieces, such as beads, macramé etc (not indicated) can be attached. The finished assembly of hollow three-dimensional components 1 and 1' can be used as a Christmas tree decoration or a toy (see FIGS. 6, 12, 19 and 27), while the product itself can be manufactured as a separate, unique set of components (see FIGS. 1-3 or 1, 7, 8 and 10, or 13, 14 and 15, or see FIGS. 20-25), which represents part of a bigger kit set, such as a gift kit for making ornaments, which can be conventionally called toys. Ornaments can represent three-dimensional geometric figures (a sphere, a cube etc), popular articles (cars, tools etc), or styled as plants, animals, fairy tale characters etc.

Let us discuss the important features of this invention.

Moulded pulp is a promising material for making blanks of ornamental articles—hollow three-dimensional components 1—thanks to its ecological properties and its suitability for various kinds of surface treatment. It is similar to Papier Mache. The draw back of this kind of materials, especially of Papier Mache, that the dimensions of spatially-rigid hollow three-dimensional components produced from them tend to vary (in comparison with conventionally flat articles), which makes it hard to use them for commercial manufacturing of identical, interchangeable—which is most important—articles. Even geometric dimensions of articles produced with identical equipment will differ their moisture content is different, which will make it impossible to assembly together individual components for example. Having cut edges 2 ensures that dimensional allowances, for example the flatness of the contact surfaces can be standardised. However allowances for outlines cannot be standardized even given cut edges 2. The same applies to the allowances for spatial arrangement, symmetry for example.

Metal and plastic articles have no such drawbacks. However, their ornamental treatment requires special equipment and materials, which makes them too expensive for an average consumer. Also, they are not easily recycled.

Use of calibrating inserts 3 eliminates the above drawbacks of articles made of moulded pulp, including composite(assembled) articles because these inserts reproduce the theoretical (correct) shape and spatial relationships of joined areas of hollow three-dimensional components 1, i.e. of inner surfaces 4, which are adjacent to the outlines of cut edges 2. If for example an article was produced in the shape of hollow three-dimensional component 1, representing half of a bell, a convex five-end star, half of an egg etc, after it has been shaped and dried, even after edges 2 were cut, its outline might become distorted. The use of calibrating insert 3 matching inner surface 4 adjacent to the outline of cut edge 2 of a bell, a star, an egg etc and manufactured, usually, from a material similar to the one the finished article is made of, such as paper, cardboard, corrugated cardboard etc, eliminates this defect completely. Insert 3 can be immobilised with respect to hollow three-dimensional component 1 by forces of friction or with glue, or both these methods can be used simultaneously. Such three-dimensional components 1 in the of incomplete (halves of) stars, bells etc can be decorated and attached to the base surface, to the office ceiling for example and thus become part of a stylish interior. Or else a single hollow three-dimensional component (1) can be attached (glued) to a second component (1'), which will produce a symmetrical three-dimensional article, which can be suspended or placed as required. Components 1 and 1' can have a common calibrating piece 3, thickness of which allows it to be in direct contact with inner surfaces 4, adjacent to the outlines of both cut edges, 2 and 2', forming joint 11, or else components 1 and 1' can have an individual insert 3 each, so that—afterwards—they can be joined not only with cut edges 2 and 2' but with surfaces 4: it will all depend on technology and purpose.

Figure 2:
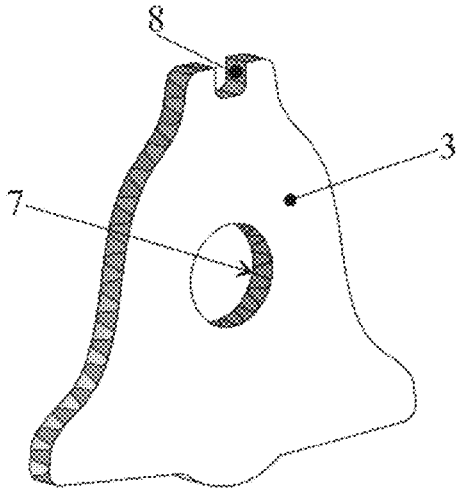
FIG. 2 shows a flat calibrating insert of the hollow three-dimensional component depicted in FIG. 1.
Figure 3:
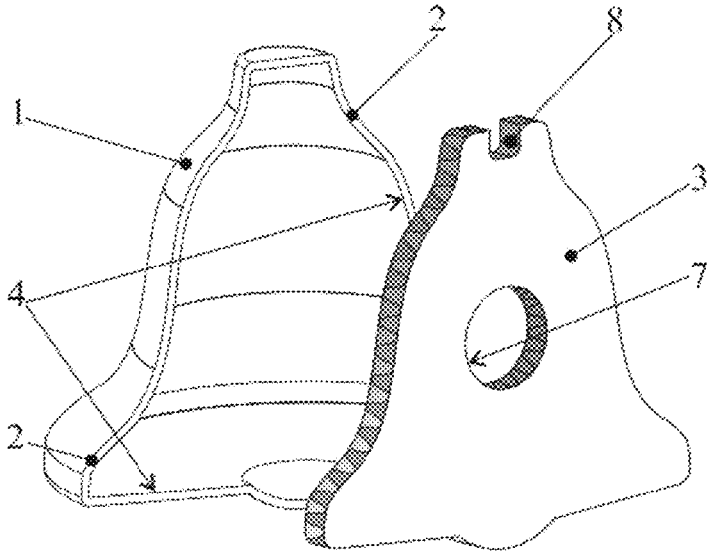
FIG. 3 shows preparation of the hollow three-dimensional component in FIG. 1 and the flat calibrating insert 2 for assembly.
Figure 4:
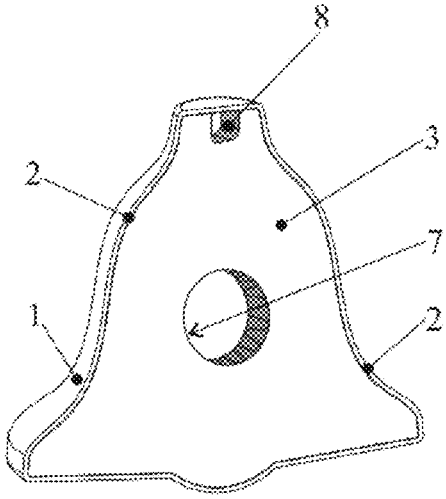
FIG. 4 shows the hollow three-dimensional object from FIG. 1 with the flat calibrating insert inside from FIG. 2.
Figure 5:
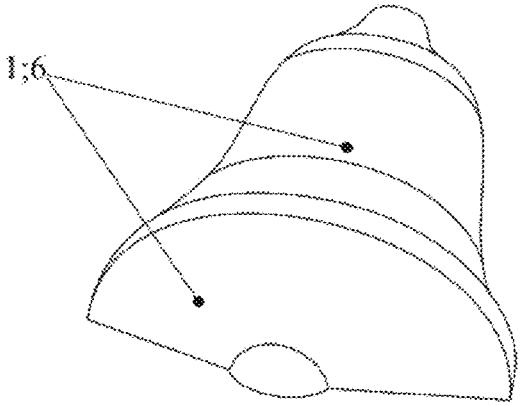
FIG. 5 shows the ornamental product "the half-bell": a blank ready for further painting and/or attaching images to its surface.
Figure 6:
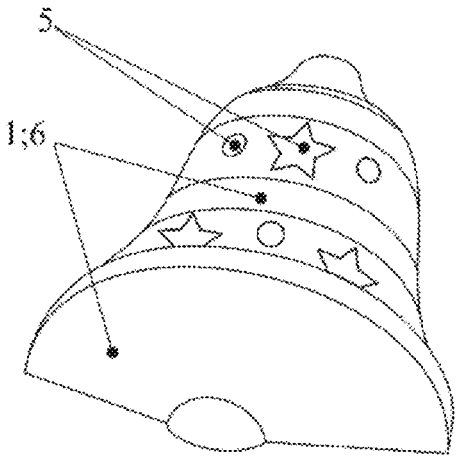
FIG. 6 shows the finished ornamental product "the half-bell", a blank ready for placing it on a flat surface.
Figure 7:
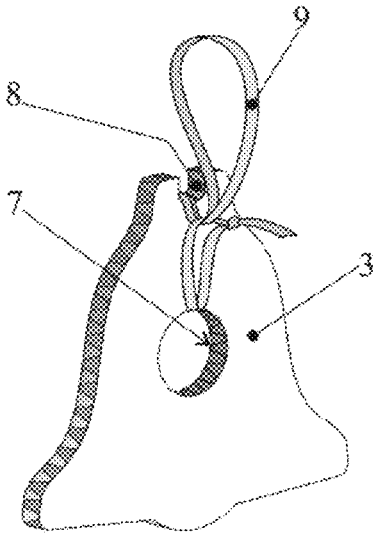
FIG. 7 shows the calibrating piece of the hollow three-dimensional component from FIG. 1 with a suspension.
Figure 8:
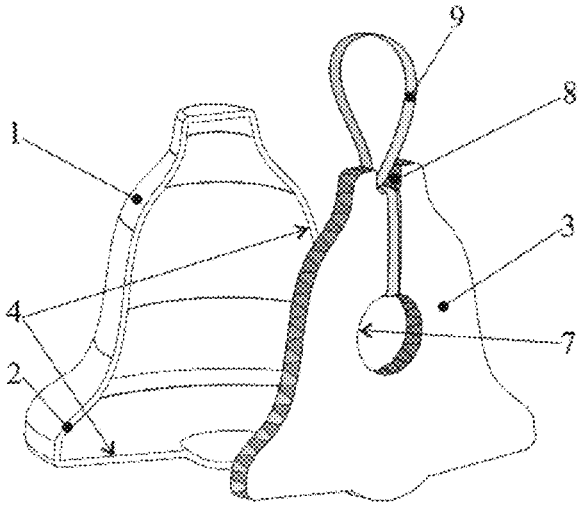
FIG. 8 shows preparation of the hollow three-dimensional component from FIG. 1 and the flat calibrating insert from FIG. 7 for assembly.
Figure 9:
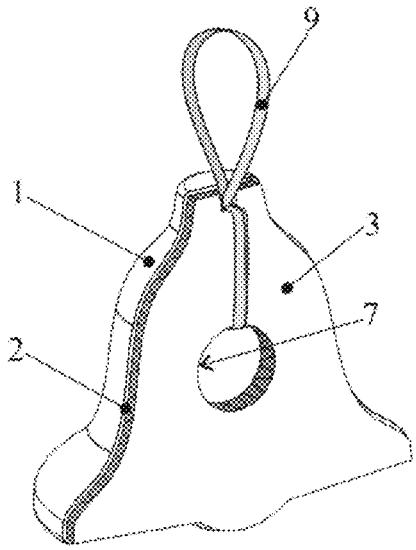
FIG. 9 shows a hollow three-dimensional component from FIG. 1 with the calibrating insert from FIG. 7 partly inserted.
Figure 10:
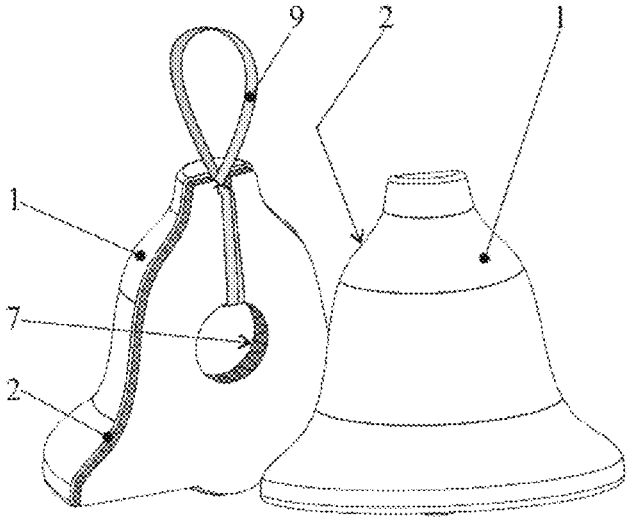
FIG. 10 shows preparation of the already assembled hollow three-dimensional component and the partly inserted calibrating insert as in FIG. 9, ready to be assembled with the second hollow three-dimensional component from FIG. 1.

Calibrating insert 3 contains at least one orifice 7 and one notch 8, where suspension 9 can be fixed (see FIGS. 2, 14 and 22). This ensures strong attachment, while not affecting the main function: standardising allowances for shape and spatial relationships. When insert 3 is placed inside a hollow three-dimensional component, one could put a finger or fingers into orifice 7, which makes assembly even easier. When orifice 7 or additional orifice 7' is located in the lower part of calibrating insert 3 (see FIGS. 14 and 22), counterweight 10, such as a bolt and nut, some plasticine or clay etc can be placed inside to ensure that the article is stable when placed on a horizontal plane. Insert 3 can carry a magnet, so that the article can be attached to a metal surface, a fridge door for example. The magnet can be replaced with a piece of double-sided scotch, which makes the article attachable to any smooth surface. However, one will not be able to remove such an article and attach it somewhere else without violating its integrity.

Joined hollow three-dimensional components 1 and 1' can be made with axial and/or planar symmetry, so that their cut edges 2 can be matched, producing straightforward, streamlined articles. Example of such articles are bells, eggs, stars, animals, people etc.

On the other hand, hollow three-dimensional components 1 and 1' can be made asymmetrical, and their cut edges 2—matching at least along some part of their outlines. This is suitable for producing more complex articles, such as a teapot with a spout and a lid (including a removable one), people and animals in different postures etc.

Glue is best suited for producing permanent joints of hollow three-dimensional components 1 and 1' with each other and/or with a base surface and/or flat calibrating insert 3. However they can also be sewn together or covered with a thick layer of typographical polish etc.

Surface 6 of the finished blank can be painted, or it can carry various images 5. It can also be decorated additionally with separate ornamental pieces, such as beads, macramé etc. Consequently, using hollow three-dimensional components 1 and 1' in a desired fashion, one can produce a Christmas tree decoration or a similar toy with specific ornamental properties.

The inventor believes that this ornamental product can be used as a finished product, mass produced in the fashion Christmas tree decorations are produced or else function as part of a certain kit set consisting of various hollow three-dimensional components 1, which can be assembled into various blanks and prepared for painting and/or for having images 5 attached to their surface 6. Thus, one can obtain pieces for games, entertainment or for developing craft skills or mental agility. These articles can be made by children or adults, producing unique ornamental pieces of different artistic merit.

One of the possible and preferable methods used for making such ornamental articles includes the following technological operations.

Thin paper pulp is prepared from the wastes of printing industry. Applying vacuum and an embossed punch, a shell is formed, or putting it in more technological terms, a great number of identical future hollow three-dimensional components 1 are formed. They are partly calibrated with the matrix and sent on for drying. After they have been dried, edges 2 are cut—technological allowances removed—and finished hollow three-dimensional components 1 are packed into a container.

Symmetrical and asymmetrical hollow three-dimensional components 1 for future ornamental objects are manufactured in the same fashion.

Calibrating inserts 3 with notch 8 and holes 7 and 7', are made, using cutting dies. The outline of each insert 3 corresponds to the 'ideal' outline of a part of inner surface 4 adjacent to cut edge 2 of hollow three-dimensional component 1.

Then, using the articles produced by moulding and die cutting, a kit set is made for do-it-yourself ornamental articles, in particular for producing a set of original Christmas tree decorations.

Making ornamental decorations can be regarded as an engaging game and entertainment, or a tool for developing creativity and other skills (motor skills of hands for example) and sagacity of children or adults: in accordance with the creative and intellectual potential of specific groups of people with their existing practical skills.

Let us look at some example of implementation of this invention.

EXAMPLE 1

Making the 'Half-Bell' Toy (See FIG. 1-6)

Component 1, the so-called half of the 'bell' with a cut edge 2 is moulded from paper pulp. A flat calibrating insert 3 is cut from micro corrugated cardboard, using cutting dies.

The components produced are either sold to consumers for making an ornamental 'half-bell' article or passed on for assembly and surface decoration, using specially developed technology in industrial conditions, and machines, including automatic ones.

Glue is applied to inner surface 4 of hollow three-dimensional component 1 adjacent to cut edge 2; then calibrating piece 3 is placed inside, with the help of a finger pushed through hole 7, so that not to let the calibrating insert extend beyond cut edge 2. If necessary, the seam can be covered with glue once more. The glued blank can be sanded with emery paper all over, including the glued seam. Now the lightweight and strong 'half-bell' blank is ready for further decoration. It is sufficient to decorate only the convex three-dimensional part of the blank. It can be primed, and outer surface 6 of component 1 can be painted, or it can be covered with special glue and decorated with mosaic patterns made from beads for example, etc.

The finished ornamental piece can be used as a free standing article and placed on a horizontal surface or it can be glued to the fridge door for example.

EXAMPLE 2

Making Christmas Tree Decoration "Bell" (FIGS. 7-12)

One half of a bell and flat calibrating insert 3 are produced as described in Example 1.

The following technological features must be mentioned.

Suspension 9, a loop made out of a cord for example, is tied to insert 3 by passing it through hole 7 and fixing it in notch 8. Glue is applied to the outline of inner surface 4 of hollow three-dimensional component 1, adjacent to cut edge 2; then insert 3 is put in place in such a fashion that a part of it extends beyond cut edge 2: to be attached to the next (second) hollow three-dimensional component 1'. Glue is also applied to the outline of inner surface 4 of the second hollow three-dimensional component 1', adjacent to cut edge 2'. Then it is joined with the protruding part of calibrating insert 3, which has been glued to the first three-dimensional component 1. If necessary, seam 11 can be covered with glue once more. The finished blank, including seam 11, can be sanded with fine emery paper.

This ornamental article can be suspended on a Christmas tree, using suspension 9.

EXAMPLE 3

Making Toys for 'the Starry Sky' (not Shown in the Diagrams)

The same operations were used as in Examples 1 and 2. Only one hollow three-dimensional component was used: 'half a star' and the calibrating insert was placed flush with the component spread with glue.

The convex three-dimensional part of the article was decorated. Then, double-sided scotch or glue etc was glued to the back of the insert and the half-star was ready to be attached to the ceiling. The same operation was carried out all the other stars, convex on one side only. However these stars can be turned into two-sided ones if desired.

EXAMPLE 4

Making the Toy 'Angel' (See FIGS. 13-19)

The same operations were used as in Examples 1-3 with the exception that suspension 9 was attached to the flat calibrating insert and counterweight 10 was placed into additional hole 7'.

Thanks to counterweight 10, the toy, painted mainly white, could be placed on a horizontal surface or, thanks to suspension 9, be suspended from any protruding object (a hook or a brunch of a Christmas tree).

EXAMPLE 5

Making the Asymmetrical Toy 'the Teapot' (See FIGS. 13-19)

The same operations were used in making the components of this product, with the exception that several separate hollow three-dimensional components 1 with cut edge 2 were made: 'a half' with a handle (1), 'a half' without a handle (1'), both with cut edges 2, and calibrated insert 3 was placed between them—i.e. the components that determine the shape of the finished article—and also the lid (the lid-cap) 12. An additional hole, 7' was made in the lower part of insert 3, for a counterweight 10.

Assembly was carried out in the same sequence as in Example 2 except that in this case it was practicable to attach suspension 9 to calibrating insert 3 and that, when this was done, components of different types need to be assembled: first the body of the teapot is assembled, then—if desired—lid 12 is glued to the body. The lid also partly fulfils the calibrating role, ensuring that the final spatial stability of the assembled blank is achieved.

If the teapot is meant to stand on a horizontal surface (a table, a floor etc), then a counterweight must be placed into additional hole 7' of the calibrating piece before assembling the article. Such counterweight can be two pieces of plasticine or clay placed on the opposite sides of the insert and connected with each other via hole 7', or it can be a short bolt with a nut etc.

The finished ornamental article 'the teapot' can be suspended or placed on a horizontal surface.

Other ornamental articles can be produced using similar operations: Easter eggs, flowers, figures of animals or people, unique chess pieces, the alphabet etc.

The above examples are hypothetical. They show only some applications of this invention.

This invention creates a new and interesting tool for games, entertainment and development of creativity and sagacity. It can be used for making ornamental articles of different artistic merit at home, by children or adults. The product is characterised by a simple design and good stability, is ecologically clean and can be fully recycled naturally. This invention n also contributes to solving the problem of recycling secondary paper materials.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An ornamental article formed from molded paper pulp material, said ornamental article comprising:

a pair of hollow halves each presenting a cut edge, which join together to form a hollow three-dimensional ornamental article;

a substantially planar calibrating piece defining a planar body having at least one orifice and one notch; wherein said notch is spatially separate from said orifice, is located along the outer edge of said substantially planar calibrating piece, and extends into the planar body of said substantially planar calibrating piece; and wherein said calibrating piece, absent the notch, has substantially the same size and shape as a cross-section of said hollow three-dimensional ornamental article; and a suspension for suspending said hollow three-dimensional ornamental article that extends through and between at least one orifice and said notch;

wherein said calibrating piece is positioned completely inside of said hollow three-dimensional ornamental article and defines a side edge that engages said cut edges of said pair of hollow halves as said cut edges join with one another at said side edge thereby forming said hollow three-dimensional ornamental article.

2. The ornamental article as set forth in claim 1, wherein said suspension is further defined by at least one of a cord, a thread, a paper clip.

* * * * *